US010494867B1

(12) United States Patent
Fort

(10) Patent No.: US 10,494,867 B1
(45) Date of Patent: Dec. 3, 2019

(54) SIMPLY SAFE LADDER CLAMP

(71) Applicant: Marc Fort, Slippery Rock, PA (US)

(72) Inventor: Marc Fort, Slippery Rock, PA (US)

( * ) Notice: Subject to any disclaimer, the term of this patent is extended or adjusted under 35 U.S.C. 154(b) by 0 days.

(21) Appl. No.: 16/163,147

(22) Filed: Oct. 17, 2018

(51) Int. Cl.
*E06C 7/48* (2006.01)

(52) U.S. Cl.
CPC ..... *E06C 7/486* (2013.01)

(58) Field of Classification Search
CPC . E06C 7/486; E06C 7/48; B25B 5/101; B25B 5/067; F16B 2/02; F16B 2/065
See application file for complete search history.

(56) References Cited

U.S. PATENT DOCUMENTS 746,188 A * 12/1903 Sonsthagen ..... A61G 7/05 248/229.15
5,286,211 A * 2/1994 McIntosh ..... H01R 4/64 439/100
5,626,320 A * 5/1997 Burrell ..... B64D 43/00 248/227.4
6,601,813 B1 * 8/2003 Kager ..... A45D 20/12 248/314
6,722,643 B1 * 4/2004 Kurtz ..... B25B 5/10 269/249
6,957,795 B1 * 10/2005 Hsieh ..... F16B 2/12 248/231.51
7,891,618 B2 * 2/2011 Carnevali ..... A47B 21/0314 248/228.5
8,695,957 B2 * 4/2014 Quintania ..... B25B 5/006 248/309.1
2015/0191976 A1 * 7/2015 Mosier ..... E06C 7/188 182/107
2015/0219131 A1 * 8/2015 Quintania ..... B25B 5/006 248/230.6

* cited by examiner

*Primary Examiner* — Anita M King
(74) *Attorney, Agent, or Firm* — Richard K Thomson

(57) ABSTRACT

A simply safe ladder clamp includes a first generally Sigma-shaped body portion having a first downwardly extending arm 2 and a second downwardly extending arm which together subtend and define an intermediate element with an inner laterally extending flat surface and a recess adjacent the first downwardly extending arm. A clamping member captures a flat portion of the gutter between the flat portion and an inner surface of the first downwardly extending arm to mount the simply safe ladder clamp to the gutter. Preferably two simply safe ladder clamps are used, positioned inside the legs of a ladder to prevent movement of the ladder relative to the gutter.

3 Claims, 4 Drawing Sheets

SIMPLY SAFE LADDER CLAMP

BACKGROUND AND SUMMARY OF THE INVENTION

The present invention is directed to the field of safety. More particularly, the present invention is directed to an elegantly simple ladder clamp that is simply safe.

Numerous attempts have been made to produce a ladder clamp which prevents a ladder from sliding along the face of a gutter thereby putting the ladder climber at risk for life and limb. Applicant's earlier invention, Ladder-Supporting Gutter Clamping System, U.S. patent application Ser. No. 15/916,507 filed Mar. 9, 2018, goes a long way toward providing a simplified, effective ladder clamp. However, the present invention takes an additional step at providing simple, effective ladder clamps that can be produced inexpensively without jeopardizing effectiveness resulting in a clamp that is truly, simply safe.

The present invention is a simply safe ladder clamp for gutters having a front face with a portion which has a generally vertical face with an inwardly protruding flange, said clamp comprising a) a generally Sigma-shaped body portion having a first downwardly extending arm and a second downwardly extending arm, the first and second downwardly extending arms subtending an intermediate element having an inner laterally extending flat surface and a recess adjacent the first downwardly extending arm, the first downwardly extending arm engaging an external portion of the vertical face of the gutter and the recess accommodating the inwardly protruding flange of the gutter; b) a clamping member having a first flat face for engaging the laterally extending surface of the body portion and a second orthogonal flat face for engaging an inner surface of the vertical face of the gutter opposite the first downwardly extending arm to clamp the simply safe ladder clamp to the vertical face of the gutter; c) an elongated threaded member: i) extending through and having threaded engagement with an opening in the second downwardly extending arm; and, ii) extending through and having non-threaded engagement with an opening in the clamping member; d) cap means securing a first end of the elongated threaded member to the clamping member in a manner permitting rotation; e) a manually engageable element secured to a second end of the elongated threaded member, whereby rotation of the elongated threaded member causes movement of the clamping member from a first non-clamping position to a second clamping position engaging the inner surface of the vertical surface of the gutter. The simply safe ladder clamp may have an outer portion of the subtended intermediate element being arcuate. The manually engageable element can comprises a five-star knurled grip thumb screw cap.

Various other features, advantages, and characteristics of the present invention will become apparent after a reading of the following detailed description.

BRIEF DESCRIPTION OF THE DRAWINGS

The preferred embodiment(s) of the present invention is/are described in conjunction with the associated drawings in which like features are indicated with like reference numerals and in which.

DETAILED DESCRIPTION OF THE PREFERRED EMBODIMENT(S)

Figure 1:
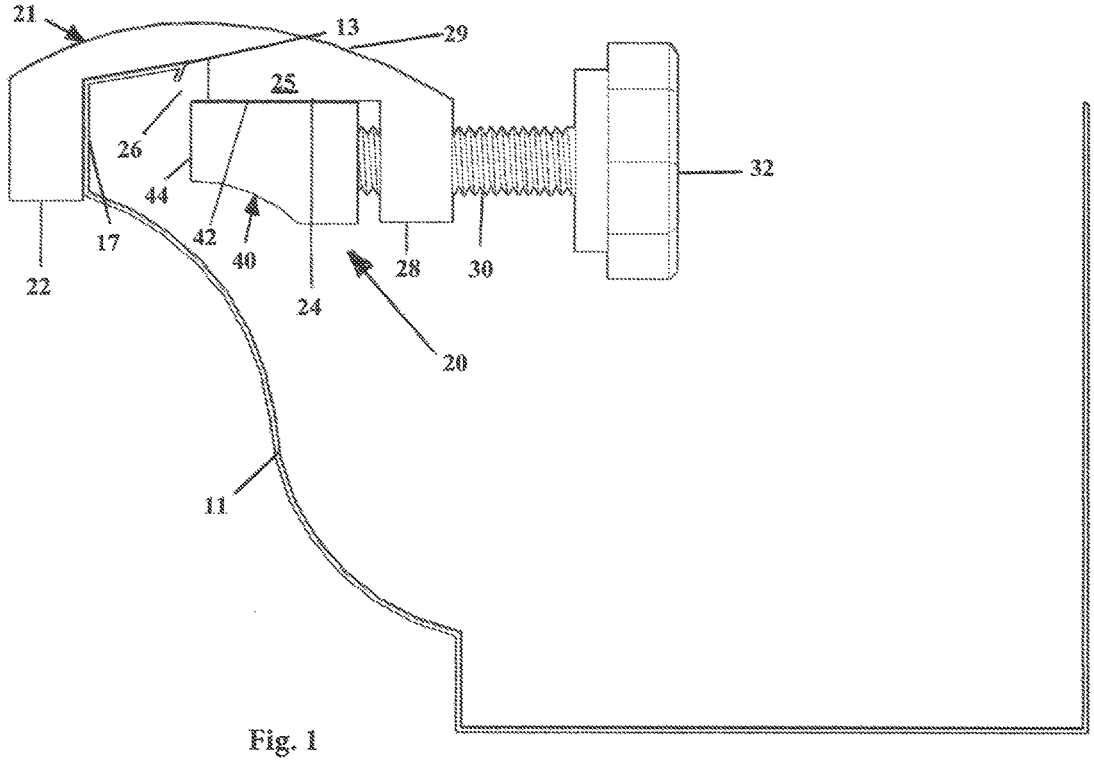
FIG. 1 is a schematic side view of the ladder clamp of the present invention in an open position.
Figure 2:
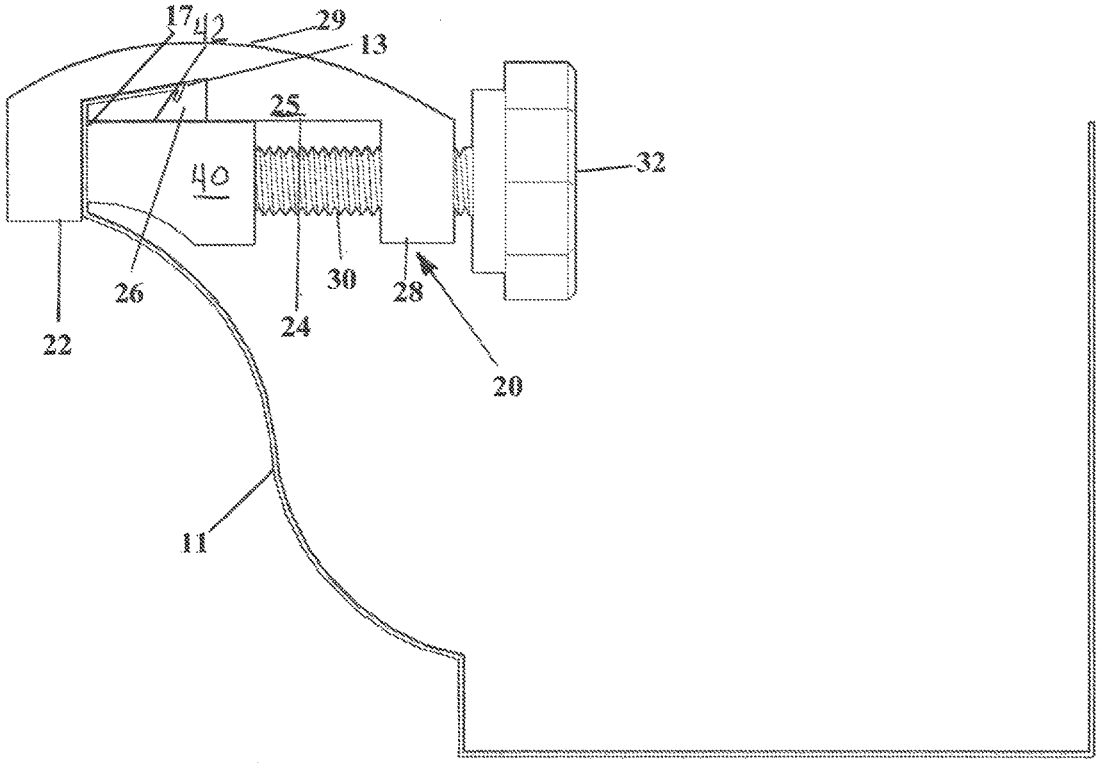
FIG. 2 is a is a schematic side view of the ladder clamp in the closed clamping position.
Figure 3:
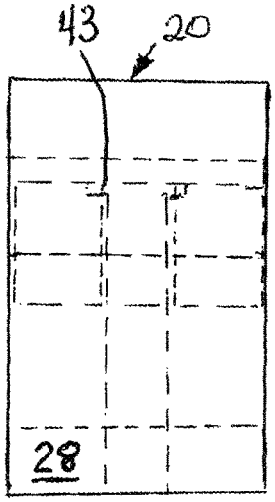
FIG. 3 is a top view of the ladder clamp of the present invention shown in the closed clamping position.

A first embodiment of the simply safe ladder clamp of the present invention is depicted in FIGS. 1-3 generally at 20. Simply safe ladder clamp 20 comprises a first generally Sigma-shaped body portion 21 (the E is rotated 90° clockwise in FIGS. 1 and 2) having a first downwardly extending arm 22 and a second downwardly extending arm 28 which together subtend and define an intermediate element 25 with an inner laterally extending flat surface 24 and a recess 26 adjacent the first downwardly extending arm 28. Recess 26 is formed to accommodate the inwardly protruding flange 13 of gutter 11.

Figure 4A:
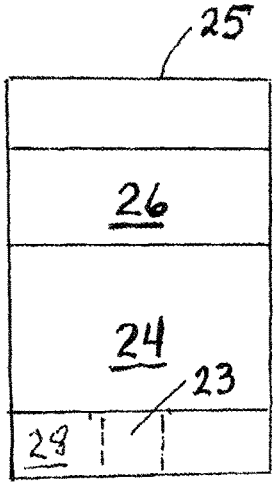
FIG. 4A is a bottom view of the body portion of the ladder clamp.
Figure 4B:
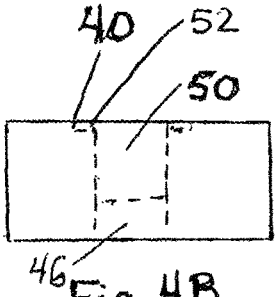
FIG. 4B is a bottom view of the clamping member of the ladder clamp.

A clamping member 40 has a first flat face 42 for engaging the laterally extending surface of intermediate element 25 of body portion 21 and a second orthogonal flat face 44 for engaging an inner surface of the vertical face 17 of the gutter 11 opposite first downwardly extending arm 22 to clamp said simply safe ladder clamp 20 to the vertical face 17 of the gutter 11. An elongated threaded member 30 extends through and has threaded engagement with an opening 23 in second downwardly extending arm 28 (FIG. 4A) and, extends through and has non-threaded engagement with an opening 46 in clamping member 40 (FIG. 4B). Cap 50 snaps or threads onto the end of threaded member 30 to prevent removal of clamping member 40 from threaded member 30. A recess 43 is formed in clamping member 40 so the flange 52 of cap 50 does not extend past the surface 44 of clamping member 40. The upper surface 29 of Sigma-shaped body portion 21 is preferably arcuate to more easily accommodate recess 26 without compromising the structural integrity of the ladder clamp 20. Manually engageable element 32 which preferably takes the form of a 5-armed star knurled grip thumb screw cap which is secured to the second end of threaded member 30.

Figure 5:
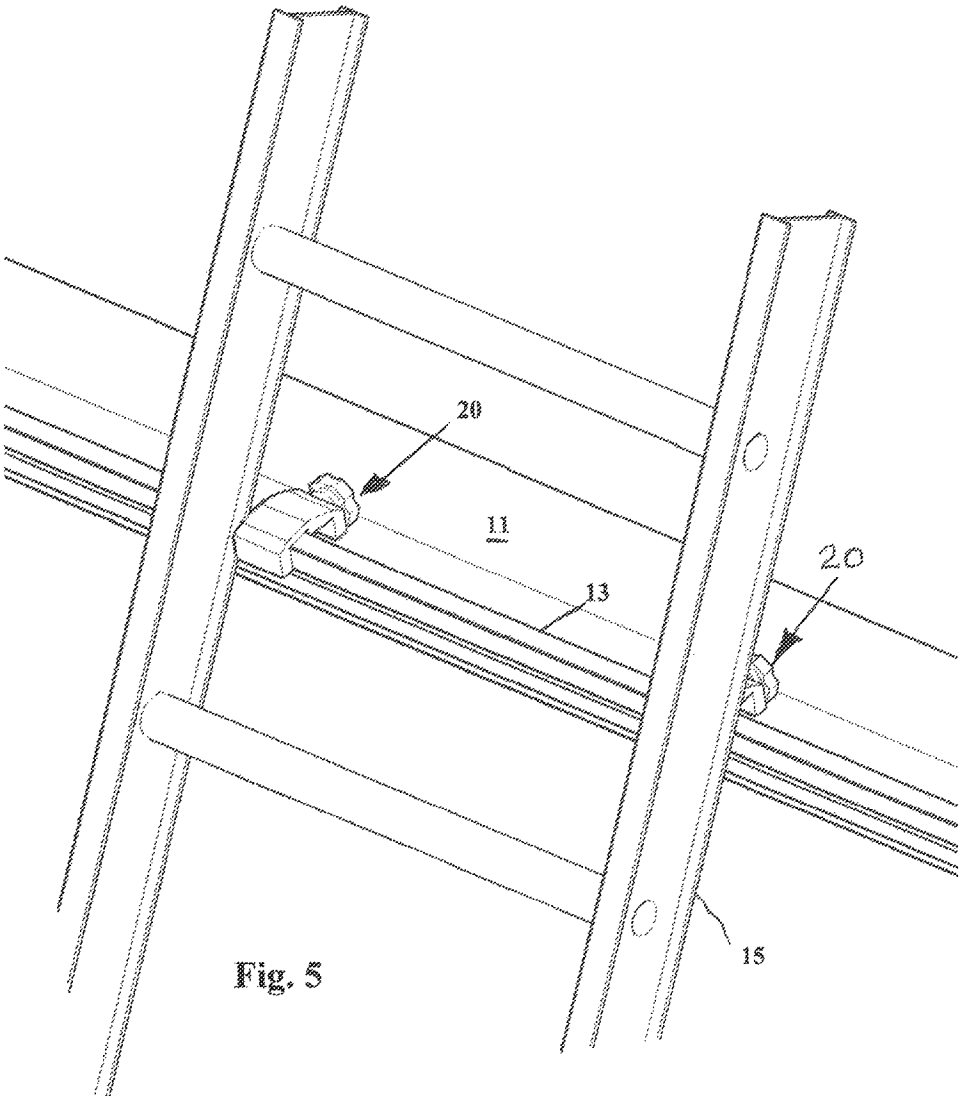
FIG. 5 is a schematic depiction of the ladder clamp of the present invention in use with a ladder.

In use, simply safe ladder clamp 20, with the clamping member 40 fully retracted (FIG. 1), is placed over inwardly protruding flange 13 of gutter 11. Thumb screw cap 32 is rotated to tighten surface 44 of clamping member 40 against the inner surface of vertical face 17 capturing vertical face 17 between inner surface of extending arm 22 and surface 44. As seen in FIG. 5, it is preferred that two simply safe ladder clamps 20 be utilized, one inside each ladder legs 15 to maintain the ladder in a fixed position relative to the gutter 11. While body portion 21 and clamping member 40 of ladder clamp 20 may be made of high-strength plastic materials, it is preferred that both members be made of metallic materials such as aluminum or steel to minimize concerns about possible breakage that would give rise to safety issues.

Various changes, alternatives, and modifications will become apparent to a person of ordinary skill in the art after a reading of the foregoing specification. It is intended that all such changes, alternatives, and modifications as fall within the scope of the appended claims be considered part of the present invention.

I claim:

1. A simply safe ladder clamp for gutters having a front face with a portion which has a generally vertical face with an inwardly protruding flange, said clamp comprising a) a generally Sigma-shaped body portion having a first downwardly extending arm and a second downwardly extending arm, said first and second downwardly extending arms subtending an intermediate element having an inner laterally extending flat surface and a recess adjacent said first downwardly extending arm, said first downwardly extending arm engaging an external portion of the vertical face of the gutter and said recess accommodating the inwardly protruding flange of the gutter;

b) a clamping member having a first flat face for engaging said laterally extending surface of said body portion and a second orthogonal flat face for engaging an inner surface of the vertical face of the gutter opposite said first downwardly extending arm to clamp said simply safe ladder clamp to the vertical face of the gutter;

c) an elongated threaded member i) extending through and having threaded engagement with an opening in said second downwardly extending arm; and, ii) extending through and having non-threaded engagement with an opening in said clamping member;

d) cap means securing a first end of said elongated threaded member to said clamping member in a manner permitting rotation of said elongated threaded member in said opening in said clamping member;

e) a manually engageable element secured to a second end of said elongated threaded member;

whereby rotation of said elongated threaded member causes movement of said clamping member from a first non-clamping position to a second clamping position engaging the inner surface of the vertical surface of the gutter.

2. The simply safe ladder clamp of claim 1 wherein an outer portion of said subtended intermediate element is arcuate.

3. The simply safe ladder clamp of claim 1 wherein said manually engageable element comprises a five-star knurled grip thumb screw cap.

* * * * *